US009814932B2

(12) United States Patent
Lai

(10) Patent No.: US 9,814,932 B2
(45) Date of Patent: Nov. 14, 2017

(54) ELLIPTICAL EXERCISER

(71) Applicant: Ying-Chou Lai, Changhua County (TW)

(72) Inventor: Ying-Chou Lai, Changhua County (TW)

( * ) Notice: Subject to any disclaimer, the term of this patent is extended or adjusted under 35 U.S.C. 154(b) by 0 days.

(21) Appl. No.: 14/940,212

(22) Filed: Nov. 13, 2015

(65) Prior Publication Data

US 2017/0014675 A1 Jan. 19, 2017

(30) Foreign Application Priority Data

Jul. 16, 2015 (TW) ..... 104123173 A
Jul. 22, 2015 (TW) ..... 104123829 A

(51) Int. Cl.

| | |
|---|---|
| ***A63B 22/04*** | (2006.01) |
| ***A63B 22/06*** | (2006.01) |
| ***A63B 22/00*** | (2006.01) |
| ***A63B 21/005*** | (2006.01) |
| ***A63B 21/22*** | (2006.01) |

(52) U.S. Cl.

CPC ..... *A63B 22/0664* (2013.01); *A63B 21/0056* (2013.01); *A63B 21/227* (2013.01); *A63B 22/001* (2013.01); *A63B 22/0012* (2013.01); *A63B 2022/0676* (2013.01)

(58) Field of Classification Search

CPC ..... A63B 22/0012; A63B 22/0664; A63B 22/001; A63B 22/0056; A63B 2022/0676; A63B 21/00912; A63B 21/005

See application file for complete search history.

(56) References Cited

U.S. PATENT DOCUMENTS

| | | | | |
|---|---|---|---|---|
| 8,021,274 | B2 * | 9/2011 | Anderson | A63B 22/001 482/52 |
| 8,216,115 | B2 * | 7/2012 | Lai | A63B 22/001 482/62 |
| 8,257,230 | B2 * | 9/2012 | Chen | A63B 21/0125 482/51 |
| 8,480,542 | B2 * | 7/2013 | Reggiani | A63B 21/00181 482/51 |
| 9,199,115 | B2 * | 12/2015 | Yim | A63B 22/001 |
| 2013/0296138 | A1 * | 11/2013 | Reggiani | A63B 21/00181 482/51 |
| 2014/0141939 | A1 * | 5/2014 | Wu | A63B 22/001 482/52 |
| 2016/0082308 | A1 * | 3/2016 | Yim | A63B 22/001 482/52 |

* cited by examiner

*Primary Examiner* — Loan H Thanh
*Assistant Examiner* — Megan Anderson
(74) *Attorney, Agent, or Firm* — Jackson IPG PLLC; Demian K. Jackson

(57) ABSTRACT

An elliptical exerciser includes a frame, first and second magnetic control wheel units, first and second swing levers, first and second transmission rods, first and second guiding mechanisms, first and second pedal rods, and a magnetic mechanism. When the first and second swing levers and the first and second transmission rods are swung forward and rearward synchronously and the first and second pedal rods are pedaled up and down to slide forward and rearward, the first and second pedal rods pivotally connected with bottom ends of the first and second swing levers are to do a tread motion of an elliptical trajectory.

2 Claims, 12 Drawing Sheets

ELLIPTICAL EXERCISER

BACKGROUND OF THE INVENTION

1. Field of the Invention

The present invention relates to an elliptical exerciser, and more particularly to an elliptical exerciser which is able to control the resistance of the elliptical exerciser separately when swung or pedaled or both.

2. Description of the Prior Art

In the field of exercise machines, an elliptical exerciser is a common machine. The use is simple. Both hands and both feet do exercise like running. The tread motion is in the way of elliptical trajectory, so it is called as an elliptical machine or an elliptical exerciser. However, the magnetic control of a conventional elliptical machine is focused on the resistance control of swing levers that swing forward and backward. Because the up and down tread resistance of pedal rods is linked by connecting rods, the structure is extremely complex. As a result, the entire elliptical machine is large in size to increase the transportation cost and occupy space.

Another shortcoming is that the resistance of both hands and the resistance of both feet are different. If the resistances of both hands and both feet are the same, it is unable to get the deserved exercise effect. The motion of both feet must accommodate to the motion of both hands. Under only one control, it cannot obtain the deserved exercise and fitness effect.

Accordingly, the inventor of the present invention has devoted himself based on his many years of practical experiences to solve these problems.

SUMMARY OF THE INVENTION

The primary object of the present invention is to provide an elliptical exerciser. The elliptical exerciser comprises a frame, first and second magnetic control wheel units, first and second swing levers, first and second transmission rods, first and second guiding mechanisms, first and second pedal rods, and a magnetic mechanism which are respectively disposed in a first frame portion, a second frame portion, and a central frame portion of the frame. When the first and second swing levers and the first and second transmission rods are swung forward and rearward synchronously and the first and second pedal rods are pedaled up and down to slide forward and rearward, the first and second pedal rods pivotally connected with bottom ends of the first and second swing levers are to do a tread motion of an elliptical trajectory.

The first and second magnetic control wheel units comprise first and second transmission wheels, first and second magnetic control wheels, first and second belt pulleys, and first, second and third transmission belts. The first belt wheel is disposed on the pivot of the first magnetic control wheel. Through the first transmission belt, the first transmission wheel brings the first magnetic control wheel to rotate. The first magnetic control wheel and the first belt pulley are coaxially disposed at a middle section of the central frame portion and located under the first transmission wheel. The second magnetic control wheel unit is disposed under the first magnetic control wheel unit. The second transmission wheel is pivoted to a lower section of the first frame portion. The second magnetic control wheel is disposed under the second transmission wheel. The second magnetic control wheel is disposed at the lower section of the first frame portion. The second belt pulley is disposed under the second magnetic control wheel. Through the second transmission belt and the third transmission belt, the second belt pulley links the second transmission wheel and the second magnetic control wheel to rotate, respectively.

The first and second swing levers are located two sides of the first and second magnetic control wheel units, respectively. Central sections of the first and second swing levers are connected to first and second swing shafts located at front ends of the first and second frame portions, respectively. The bottoms of the first and second swing shafts are pivotally connected to front ends of the first and second pedal rods. First ends of the first and second connecting rods are pivotally connected to first and second fixing seats of the first and second swing shafts, respectively. Second ends of the first and second connecting rods are pivotally connected to two sides of the pivot of the first transmission wheel respectively, enabling the first and second swing levers to swing, such that the first and second connecting rods drive the first transmission wheel by turns to rotate.

The first and second transmission rods are pivotally connected to central sections of the first and second pedal rods, respectively. Upper ends of the first and second transmission rods are pivotally connected to first and second pivotal seats. The first and second pivotal seats are fixed to first and second pivotal shafts, respectively. The first and second pivotal shafts are fixed to the first and second guiding mechanisms, respectively.

Front and rear ends of the first and second pivotal shafts are connected with the first and second pivotal seats of the first and second transmission rods and a guiding portion of the first and second guiding mechanisms, respectively. The first and second guiding mechanisms are connected with first and second eccentric shafts, respectively. The first and second eccentric shafts are provided with first and second cranks and a main shaft. The first and second cranks and the main shaft are coaxial. The main shaft penetrates the second transmission wheel.

The magnetic mechanism comprises a magnetic turning seat, first magnetic members, and second magnetic members. The magnetic turning seat is fixed to one side of the main shaft. The magnetic turning seat and the first and second cranks are coaxial. The magnetic turning seat is provided with the first magnetic members. Because the second transmission wheel, or the first and second guiding members, or the first and second transmission rods link first and second ropes synchronously, the first magnetic members bring the first and second eccentric shafts to drive the magnetic turning seat to turn synchronously. The position that the first magnetic members pass threrethrough is at the overlapping position of the zero moment of the first and second eccentric shafts where the second magnetic members are fixed at a lower section of the central frame portion. The first and second magnetic members have the same polarity to provide a repulsive force. By means of the repulsive force of the first and second magnetic members of the magnetic turning seat, the first and second eccentric shafts are pushed away from the overlapping position of the zero moment so as to get out of jamming and provide a smooth turning.

Accordingly, the first magnetic control wheel is able to control the swing resistance of the first and second swing levers independently, enabling the first magnetic control wheel to control the resistance of the back and forth slide movement of the first and second pedal rods only. The second magnetic control wheel is able to control the resistance of the up and down tread motion of the first and second pedal rods independently. The first and second swing levers and the first and second pedal rods are swung and pedaled by turns to constitute a tread motion of an elliptical trajectory, such that the mixed resistances of both hands and both feet can control the resistance, respectively.

Preferably, the guiding portion of the first and second guiding mechanisms comprises first and second guiding members. The first and second ropes are fixed to front ends of the first and second guiding members, respectively. The first and second ropes are connected with the first and second eccentric shafts, respectively.

Preferably, the guiding portion the first and second guiding mechanisms comprises third and fourth pivotal seats and first and second guiding rods. The third and fourth pivotal seats are secured on the first and second pivotal shafts, respectively. The third and fourth pivotal seats are pivotally connected with the first and second guiding rods, respectively. The first and second guiding rods are connected with the first and second eccentric shafts.

DETAILED DESCRIPTION OF THE PREFERRED EMBODIMENTS

Embodiments of the present invention will now be described, by way of example only, with reference to the accompanying drawings.

Figure 1:
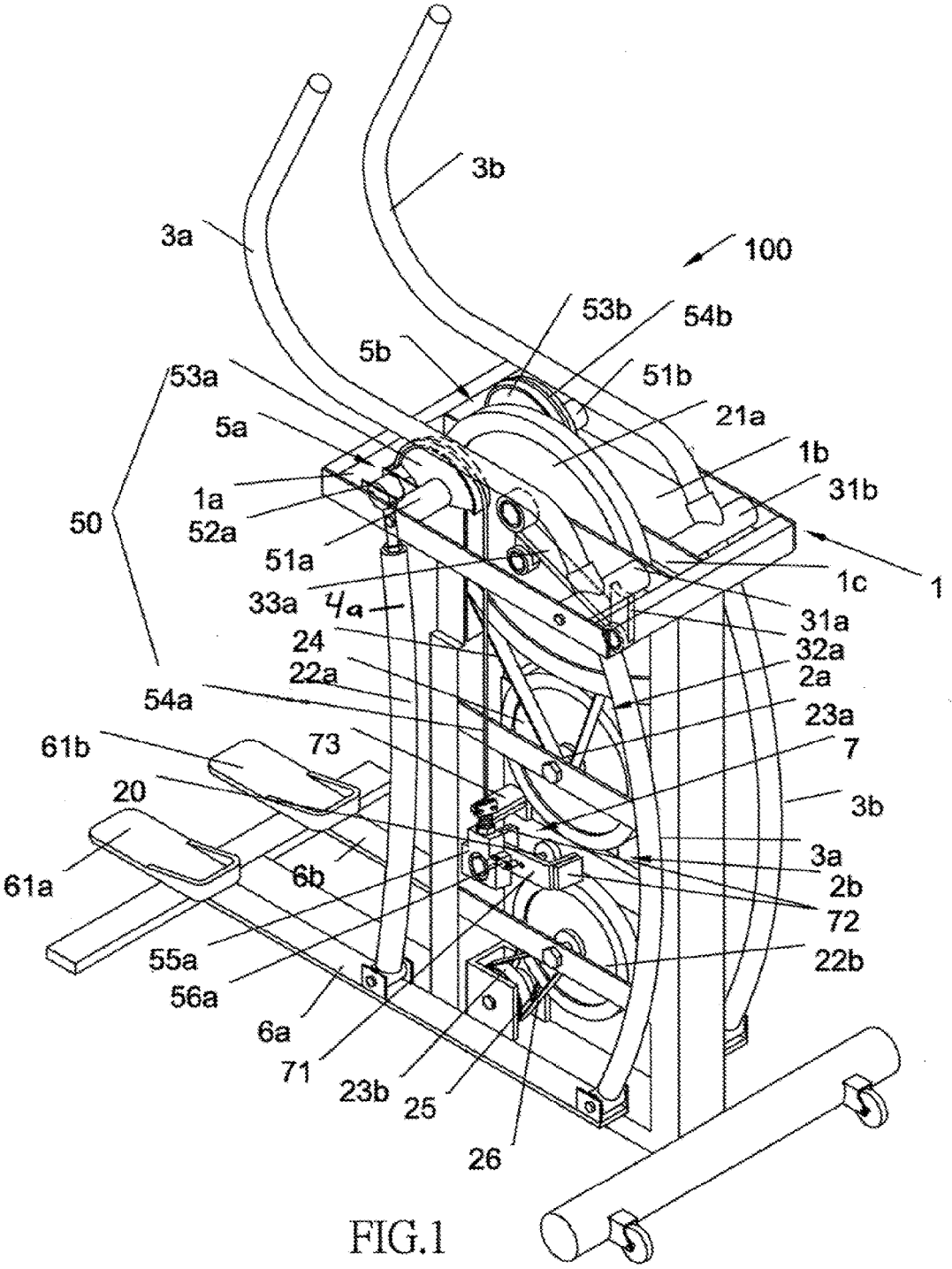
FIG. 1 is a perspective view showing the right of the elliptical exerciser according to a first embodiment of the present invention.
Figure 2:
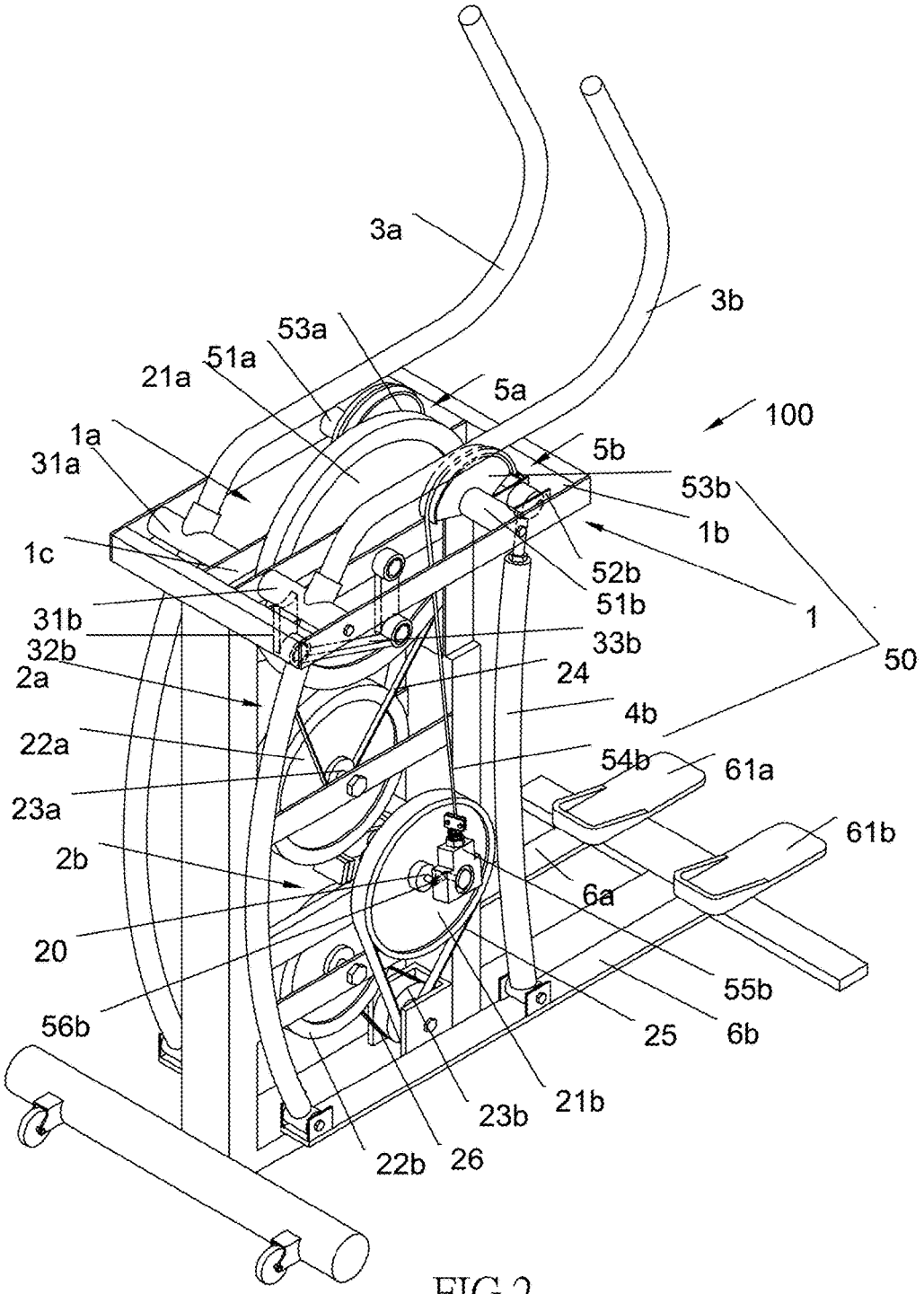
FIG. 2 is a perspective view showing the left of the elliptical exerciser according to a first embodiment of the present invention.
Figure 3:
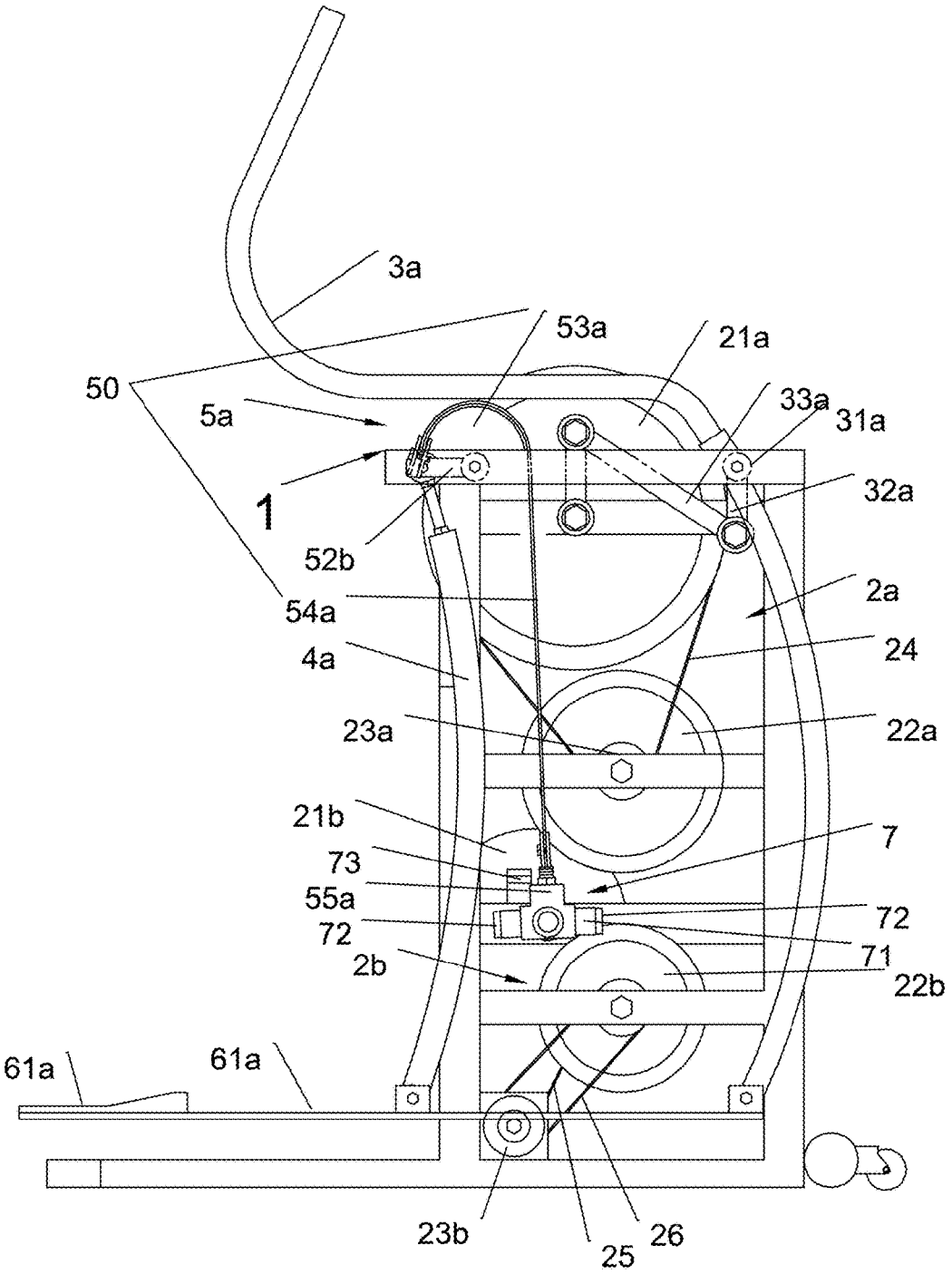
FIG. 3 is a side planar view showing the right of the elliptical exerciser according to the first embodiment of the present invention.
Figure 4:
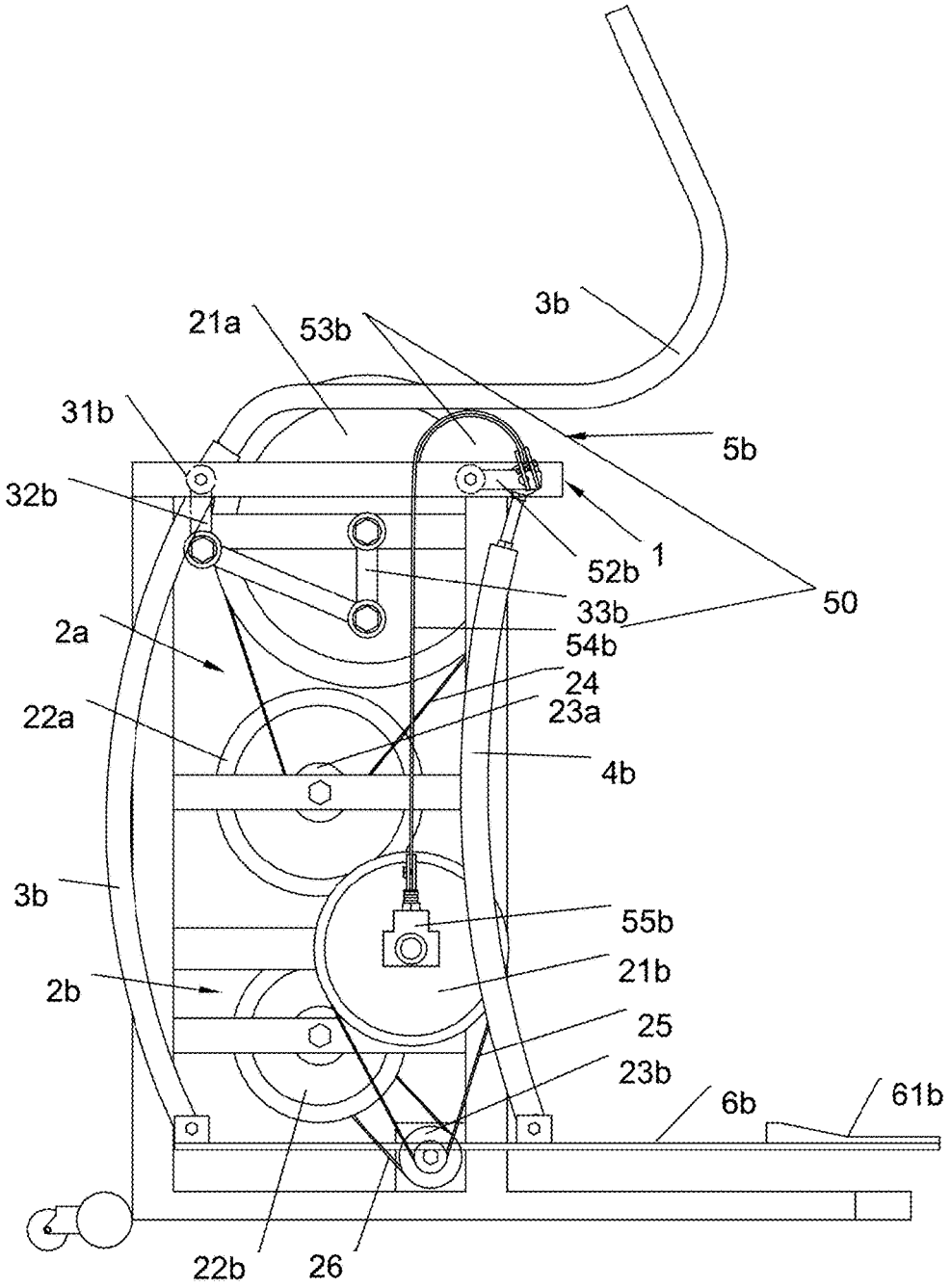
FIG. 4 is a side planar view showing the left of the elliptical exerciser according to the first embodiment of the present invention.
Figure 5:
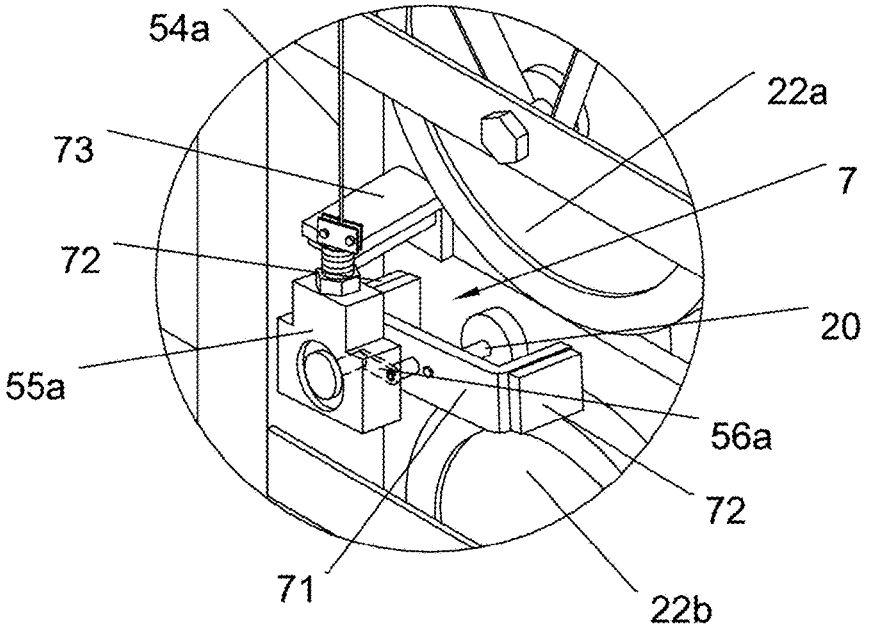
FIG. 5 is an enlarged view showing the magnetic mechanism of the elliptical exerciser according to the first embodiment of the present invention.
Figure 6:
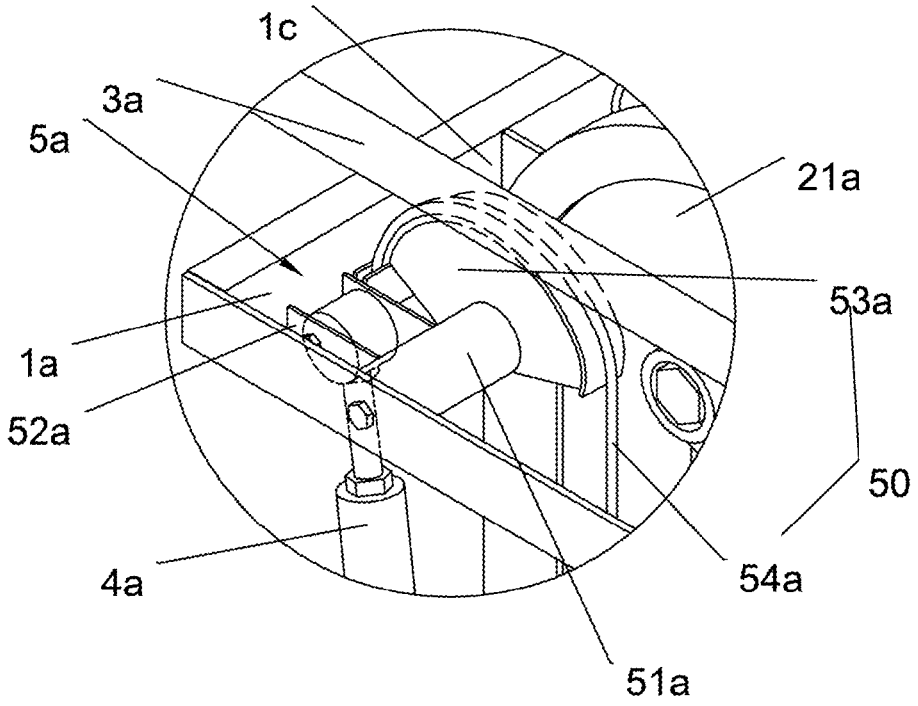
FIG. 6 is an enlarged view showing the guiding mechanism of the elliptical exerciser according to the first embodiment of the present invention.
Figure 7:
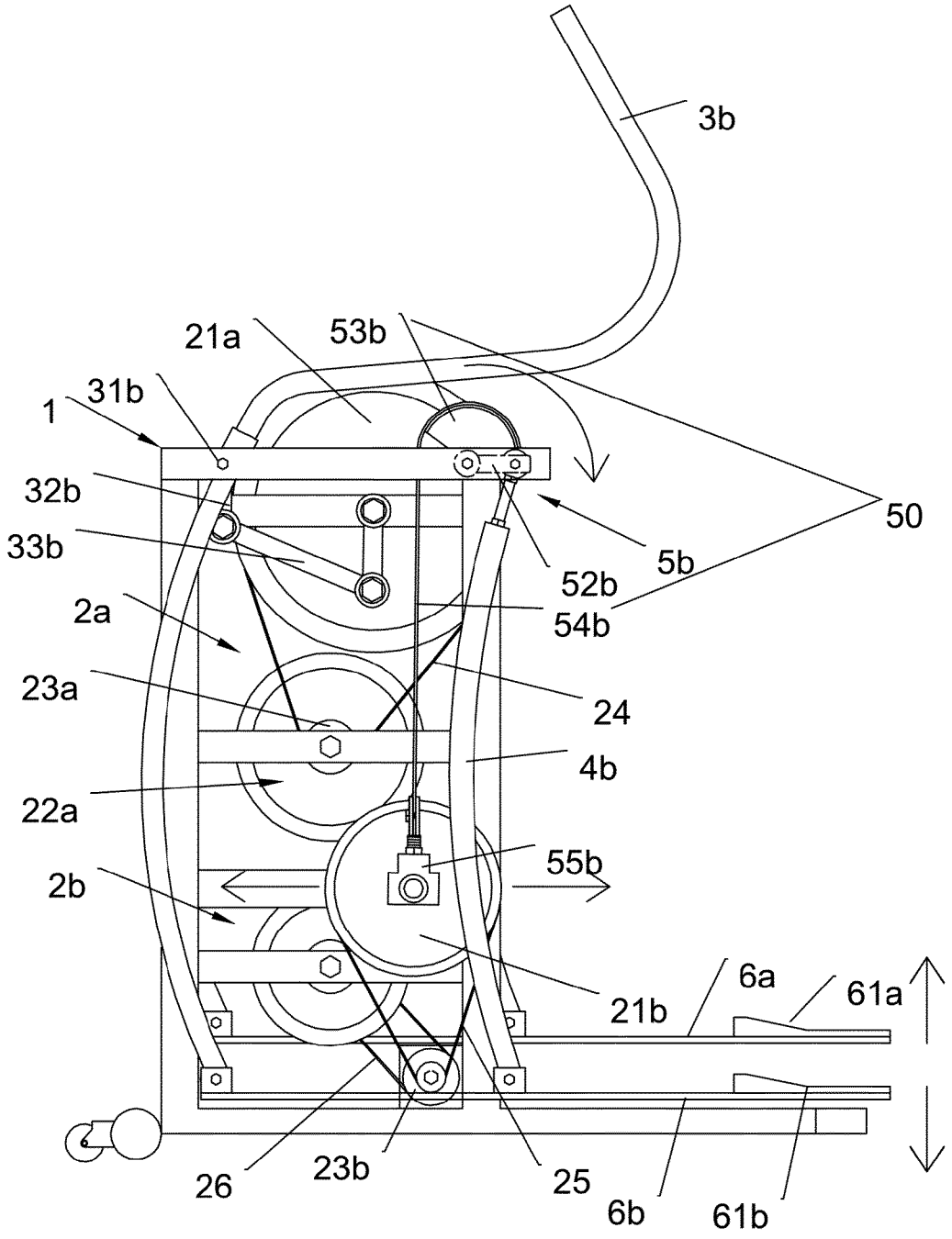
FIG. 7 is a schematic view showing that the elliptical exerciser of the first embodiment of the present invention is pedaled up and down.
Figure 8:
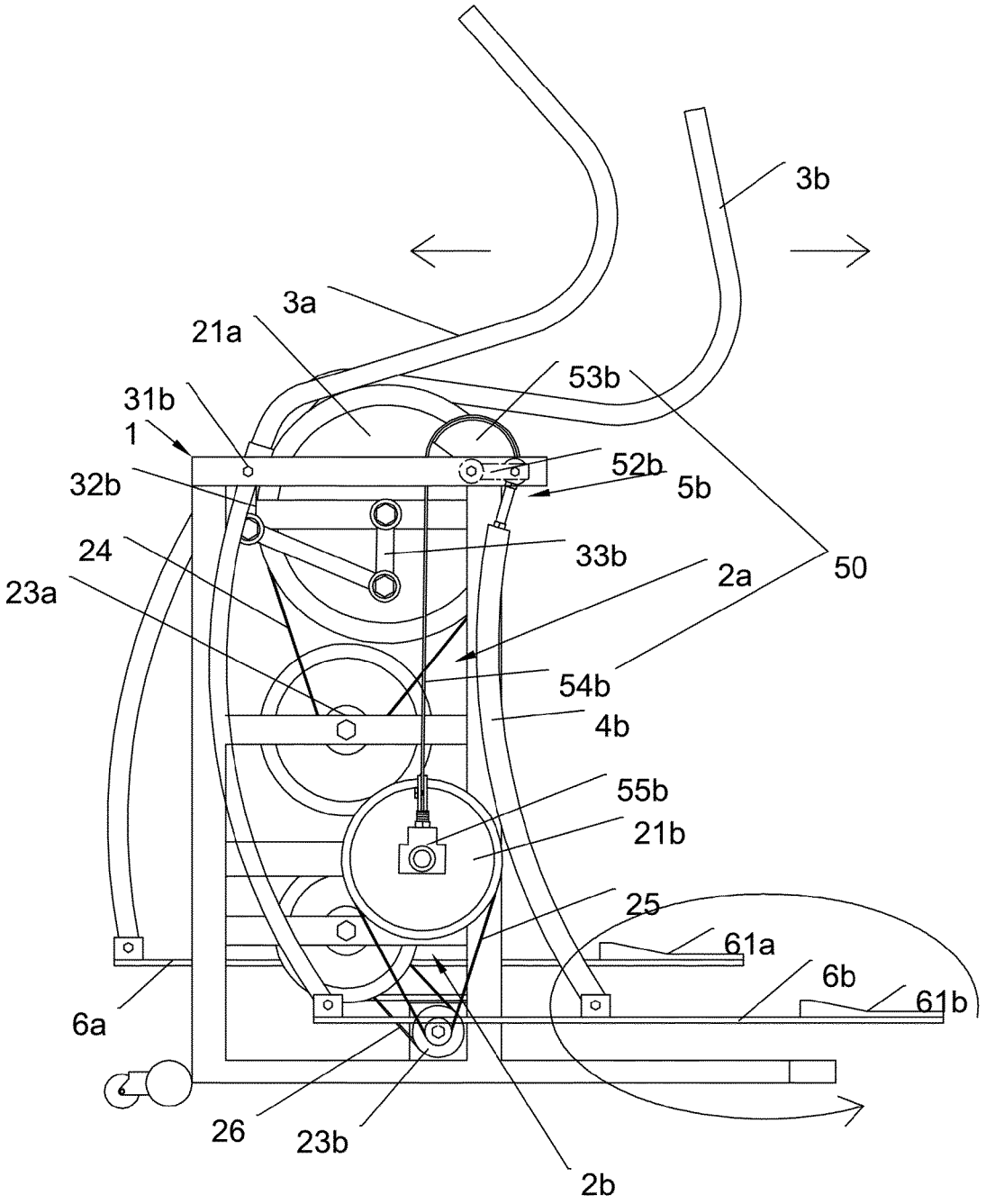
FIG. 8 is a schematic view showing that the elliptical exerciser of the first embodiment of the present invention is pedaled in the way of elliptical trajectory.
Figure 9:
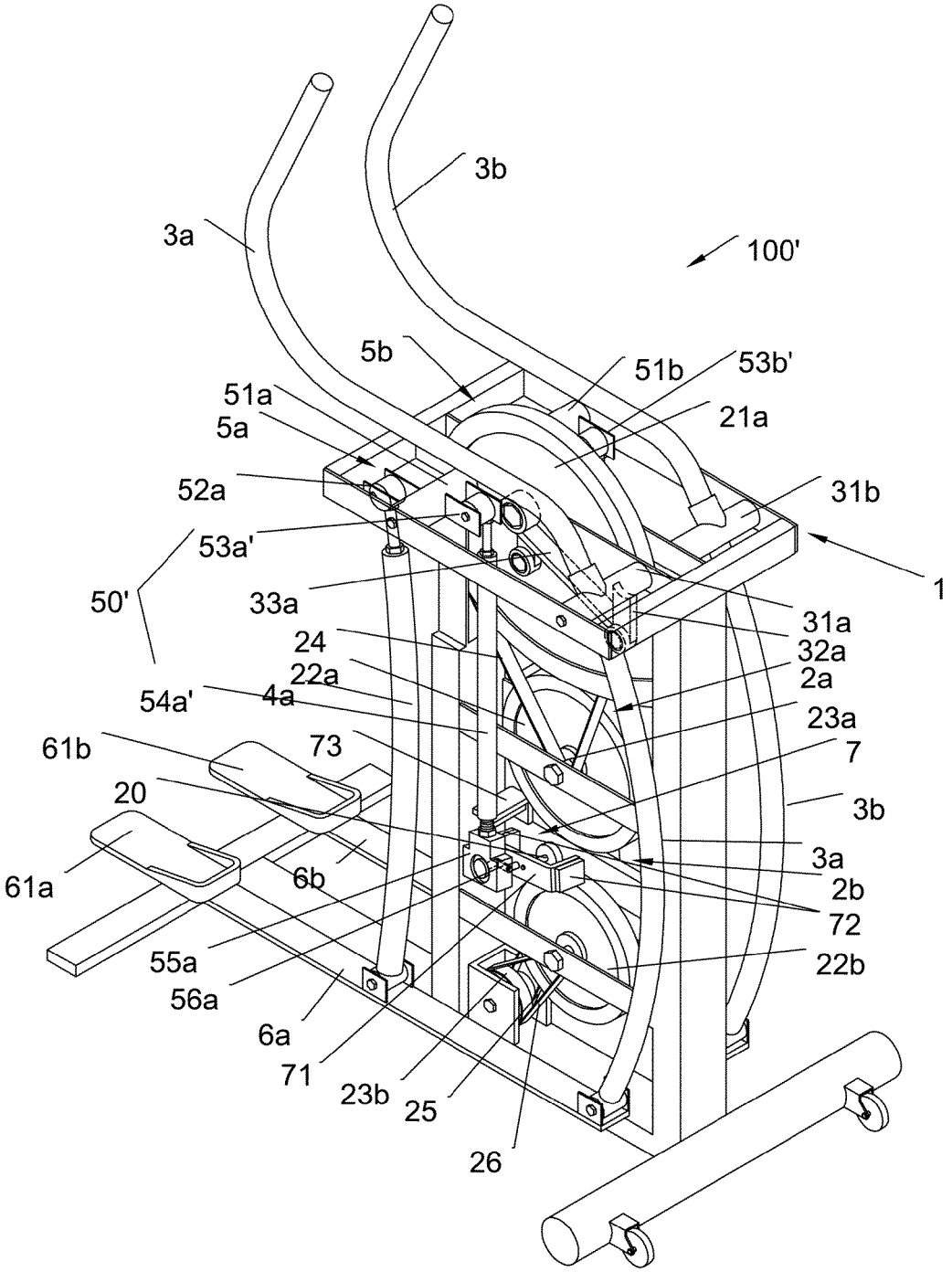
FIG. 9 is a perspective view showing the right of the elliptical exerciser according to a second embodiment of the present invention.
Figure 10:
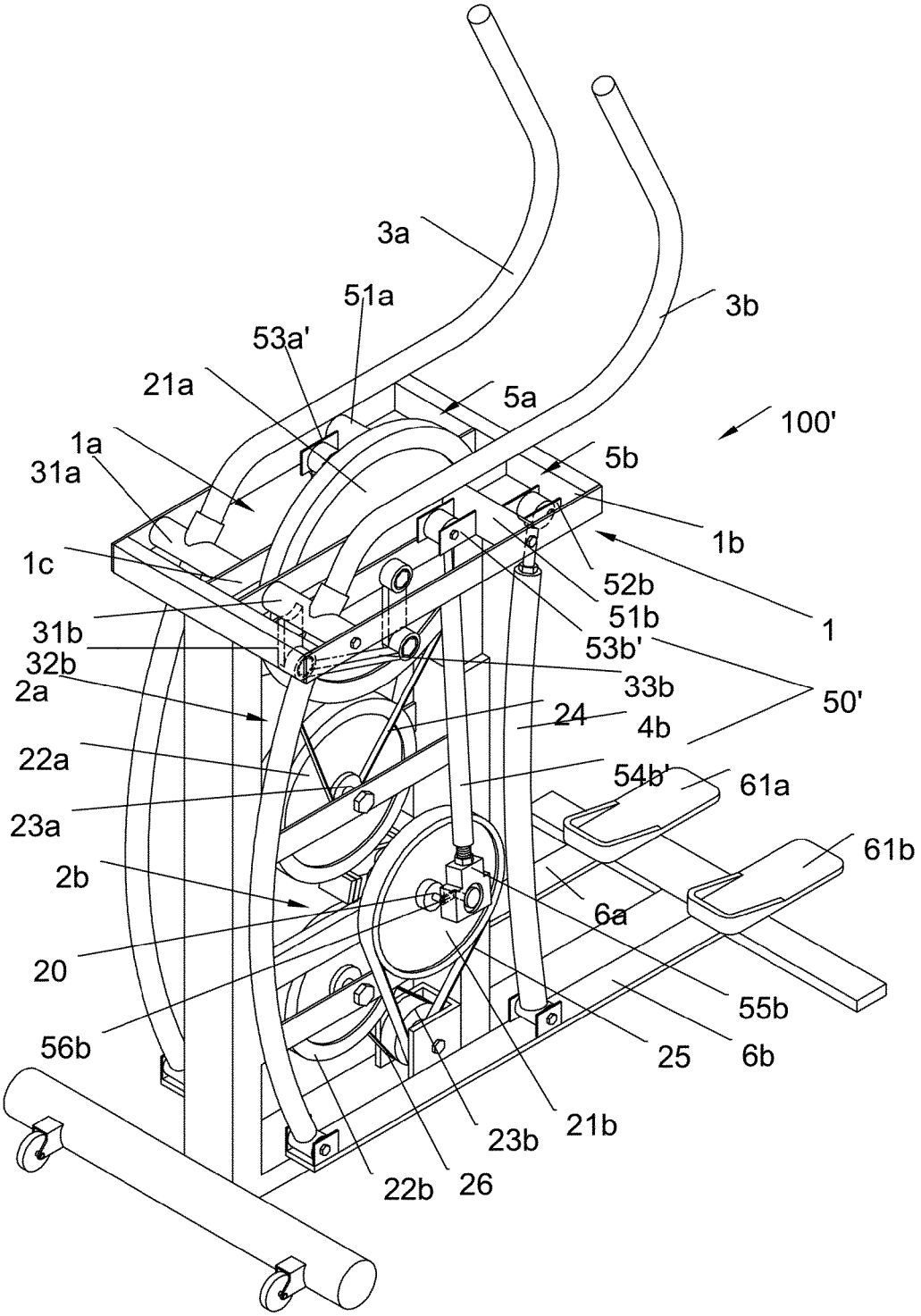
FIG. 10 is a perspective view showing the left of the elliptical exerciser according to the second embodiment of the present invention.
Figure 11:
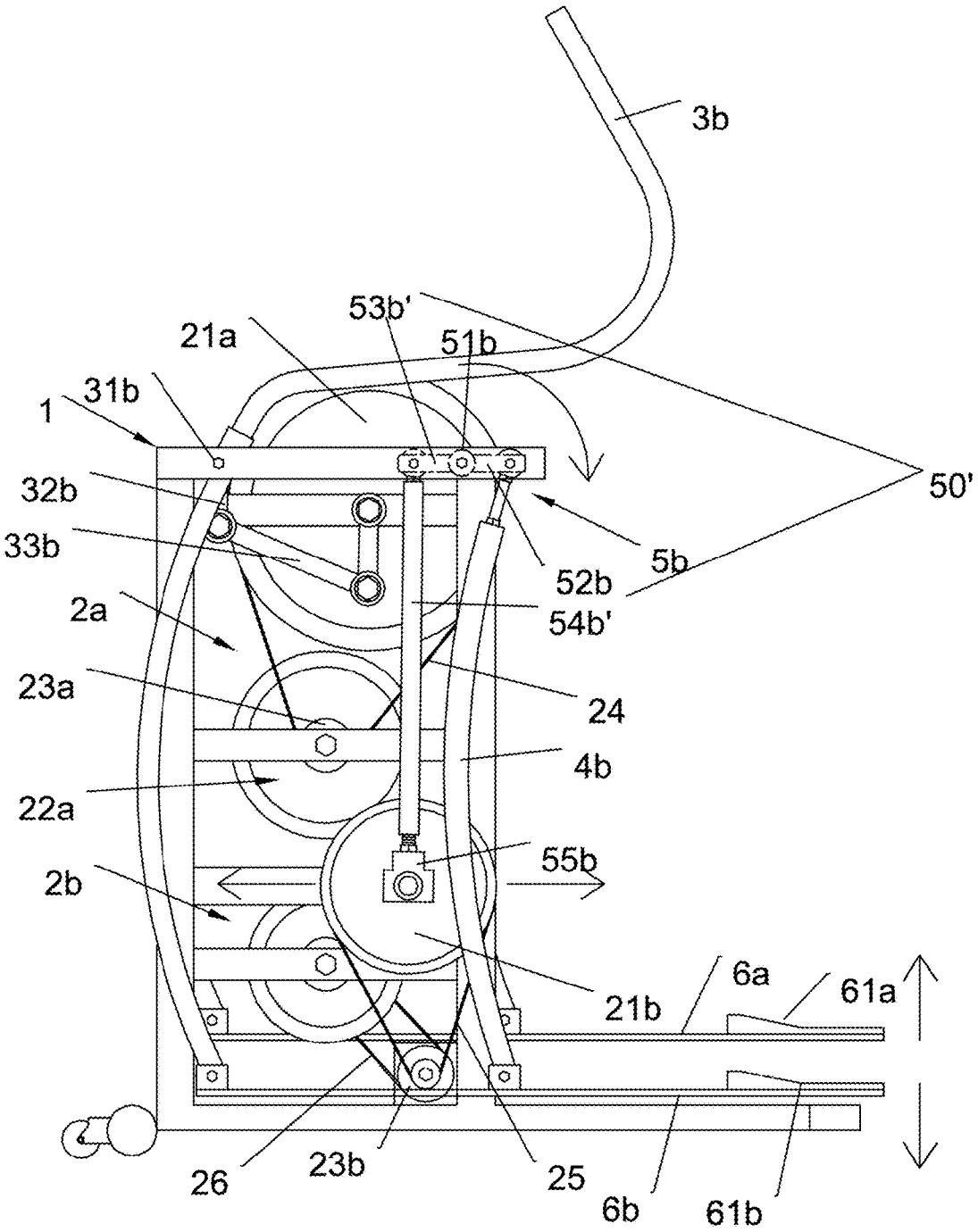
FIG. 11 is a schematic view showing that the elliptical exerciser of the second embodiment of the present invention is pedaled up and down.
Figure 12:
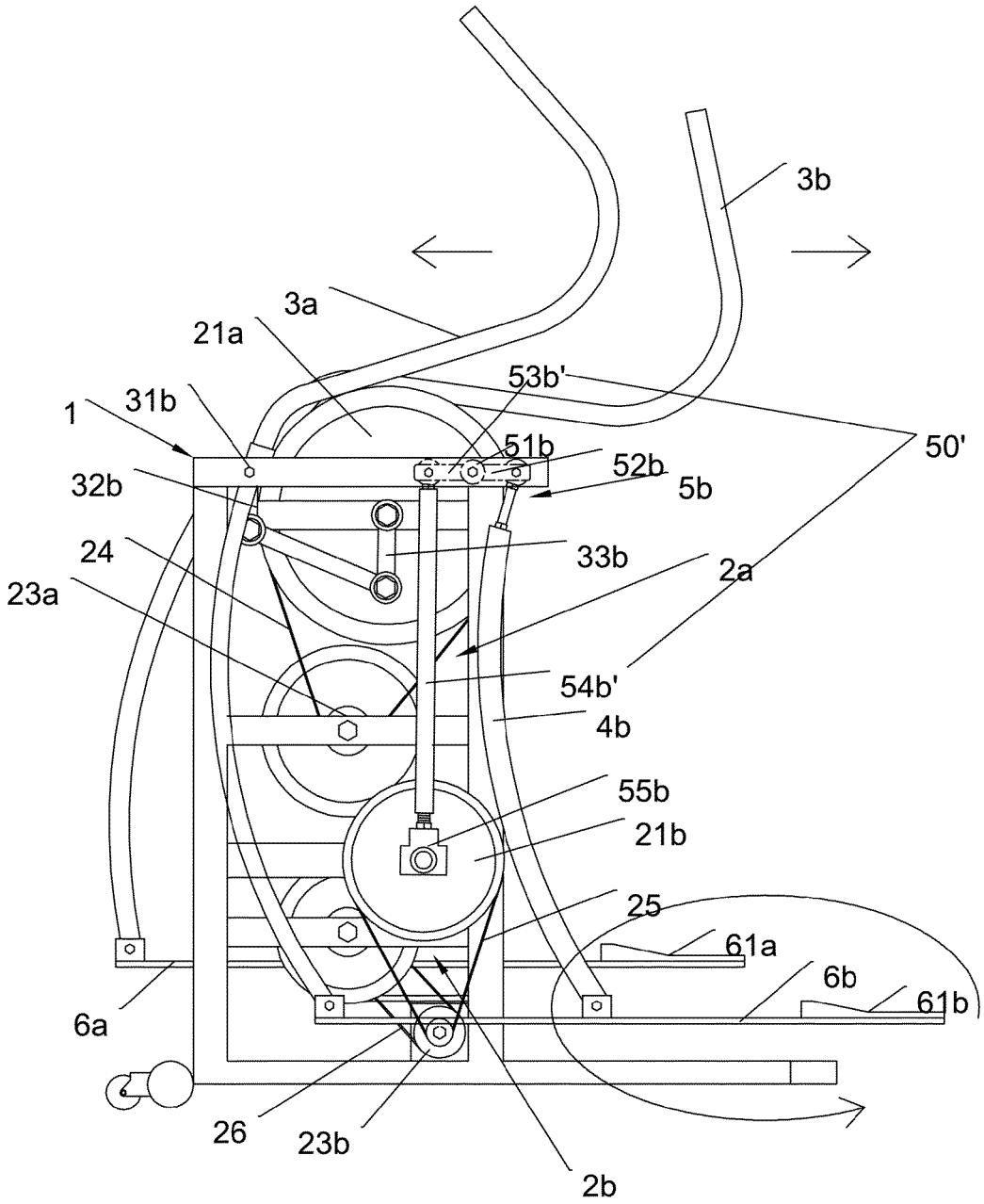
FIG. 12 is a schematic view showing that the elliptical exerciser of the second embodiment of the present invention is pedaled in the way of elliptical trajectory.

As shown in FIG. 1 through FIG. 12, an elliptical exerciser 100, 100' of the present invention comprises a frame 1, first and second magnetic control wheel units 2*a*, 2*b*, first and second swing levers 3*a*, 3*b*, first and second transmission rods 4*a*, 4*b*, first and second guiding mechanisms 5*a*, 5*b*, first and second pedal rods 6*a*, 6*b*, and a magnetic mechanism 7.

The frame 1 has a first frame portion 1*a*, a second frame portion 1*b*, and a central frame portion 1*c*. Left and right sides of the central frame portion 1*c* are connected with the first frame portion 1*a* and the second frame portion 1*b*, respectively.

The first and second magnetic control wheel units 2*a*, 2*b* are disposed in the central frame portion 1*c* of the frame 1 in a top-down way. The first and second magnetic control wheel units 2*a*, 2*b* comprises first and second transmission wheels 21*a*, 21*b*, first and second magnetic control wheels 22*a*, 22*b*, and a first belt pulley 23*a* and a second belt pulley 23*b*. The first belt pulley 23*a* is disposed on the pivot of the first magnetic control wheel 22*a*. Through a first transmission belt 24, the first transmission wheel 21*a* brings the first magnetic control wheel 22*a* to rotate. The first transmission wheel 21*a* is pivoted on the upper end of the central frame portion 1*c*. The first magnetic control wheel 22*a* and the first belt pulley 23*a* are coaxially disposed at the middle section of the central frame portion 1*c* and located under the first transmission wheel 21*a*. The second magnetic control wheel unit 2*b* is disposed under the first magnetic control wheel unit 2*a*. The second transmission wheel 21*b* is pivoted to the lower section of the first frame portion 1*a*. The second magnetic control wheel 22*b* is disposed under the second transmission wheel 21*b*. The second magnetic control wheel 22*b* is disposed at the lower section of the first frame portion 1*a*. A second belt pulley 23*b* is disposed under the second magnetic control wheel 22*b*. Through a second transmission belt 25 and a third transmission belt 26, the second belt pulley 23*b* links the second transmission wheel 21*b* and the second magnetic control wheel 22*b* to rotate, respectively.

The first and second swing levers 3*a*, 3*b* are located two sides of the first and second magnetic control wheel units 2*a*, 2*b*, respectively. Central sections of the first and second swing levers 3*a*, 3*b* are connected to first and second swing shafts 31*a*, 31*b* located at front ends of the first and second frame portions 1*a*, 1*b*, respectively. The bottoms of the first and second swing shafts 31*a*, 31*b* are pivotally connected to the front ends of the first and second pedal rods 6*a*, 6*b*. First ends of first and second connecting rods 33*a*, 33*b* are pivotally connected to first and second fixing seats 32*a*, 32*b* of the first and second swing shafts 31*a*, 31*b*, respectively. Second ends of the first and second connecting rods 33*a*, 33*b* are pivotally connected to two sides of the pivot of the first transmission wheel 21*a*, respectively, enabling the first and second swing levers 3*a*, 3*b* to swing, such that the first and second connecting rods 33*a*, 33*b* drive the first transmission wheel 21*a* by turns to rotate.

The first and second transmission rods 4*a*, 4*b* are pivotally connected to central sections of the first and second pedal rods 6*a*, 6*b*, respectively. Upper ends of the first and second transmission rods 4*a*, 4*b* are pivotally connected to first and second pivotal seats 52*a*, 52*b*. The first and second pivotal seats 52*a*, 52*b* are fixed to first and second pivotal shafts 51*a*, 51*b*, respectively. The first and second pivotal shafts 51*a*, 51*b* are fixed to the first and second guiding mechanisms 5*a*, 5*b*, respectively. As shown in FIG. 1 through FIG. 8, the first and second guiding mechanisms 5*a*, 5*b* comprise the first and second pivotal shafts 51*a*, 51*b*, a guiding portion 50, first and second guiding members 53*a*, 53*b*, first and second ropes 54*a*, 54*b*, first and second eccentric shafts 55*a*, 55*b*, first and second cranks 56*a*, 56*b*, and a main shaft 20. The first and second pivotal seats 52*a*, 52*b* and the first and second guiding members 53*a*, 53*b* of the guiding portion 50 are located on the first and second pivotal shafts 51*a*, 51*b*. First ends of the first and second ropes 54*a*, 54*b* are fixed to rear ends of the first and second guiding members 53*a*, 53*b*, respectively. The first and second ropes 54*a*, 54*b* pass around the first and second guiding members 53*a*, 53*b* to be connected to the first and second eccentric shafts 55*a*, 55*b*, respectively. The axles of the eccentric shafts 55*a*, 55*b* are connected to first ends of the first and second cranks 56*a*, 56*b*. Second ends of the first and second cranks 56*a*, 56*b* function as the axle centers and are connected to the main shaft 20. The main shaft 20 passes through the second transmission wheel 21*b*. The first and second cranks 56*a*, 56*b* and the first and second eccentric shafts 55*a*, 55*b* are located at two sides of the second transmission wheel 21*b*, respectively.

Another embodiment of the elliptical exerciser 100' is shown in FIG. 9 to FIG. 12 (in cooperation with FIG. 1 to FIG. 8). The first magnetic control wheel 22*a* of the first magnetic control wheel unit 2*a* controls the resistance of the first and second swing levers 3*a*, 3*b*. The second magnetic control wheel 22*b* of the second magnetic control wheel unit 2*b* controls the resistance of the first and second pedal rods 6*a*, 6*b*. The first and second pedal rods 6*a*, 6*b* are pedaled by turns to bring the first and second transmission rods 4*a*, 4*b*, respectively, to guide the first and second guiding mechanisms 5*a*, 5*b* by turns. A guiding portion 50' of first and second guiding mechanisms 5*a*', 5*b*' is disposed on the first and second pivotal shafts 51*a*, 51*b*. The foresaid first and second pivotal seats 52*a*, 52*b* are kept. The first and second guiding members 53*a*, 53*b* of the first embodiment are replaced with third and fourth pivotal seats 53*a*', 53*b*', and the first and second ropes 54*a*, 54*b* are replaced with first and second guiding rods 54*a*', 54*b*', with the equivalent replacement to constitute another embodiment of the present invention. Thus, the first and second transmission rods 4*a*, 4*b* are to push and pull the first and second guiding rods 54*a*', 54*b*' by turns for the first and second guiding mechanisms 5*a*', 5*b*' to bring the first and second eccentric shafts 55*a*, 55*b* to turn. The first and second eccentric shafts 55*a*, 55*b* are pivotally connected to the first and second cranks 56*a*, 56*b* respectively, enabling the first and second eccentric shafts 55*a*, 55*b* to turn at different positions so as to drive the second magnetic control wheel 22*b* and control the resistance of the first and second pedal rods 6*a*, 6*b*. The operation and function of both embodiments are the same.

As shown in FIG. 1 through FIG. 8, the magnetic mechanism 7 comprises a magnetic turning seat 71, first magnetic members 72, and second magnetic members 73. The magnetic turning seat 71 is fixed to one side of the main shaft 20. The magnetic turning seat 71 and the first and second cranks 56*a*, 56*b* are axial. The magnetic turning seat 71 is provided with the first magnetic members 72. Because the second transmission wheel 21*b*, the first and second guiding members 53*a*, 53*b*, and the first and second transmission rods 4*a*, 4*b* link the first and second ropes 54*a*, 54*b*, the first magnetic members 72 bring the first and second eccentric shafts 55*a*, 55*b* to drive the magnetic turning seat 71 to turn synchronously. The position that the first magnetic members 72 pass threrethrough is just located at the overlapping position of the zero moment of the first and second eccentric shafts 55*a*, 55*b* where the second magnetic members are fixed at the lower end of the central frame portion 1*c*. The first and second magnetic members 72, 73 have the same polarity to provide a repulsive force. By means of the repulsive force of the first and second magnetic members 72, 73 of the magnetic turning seat 71, the first and second eccentric shafts 55*a*, 55*b* are pushed away from the overlapping position of the zero moment so as to get out of jamming and provide a smooth turning.

As shown in FIG. 9 through FIG. 12, the magnetic mechanism 7 comprises a magnetic turning seat 71, first magnetic members 72, and second magnetic members 73. The magnetic turning seat 71 is fixed to one side of the main shaft 20. The magnetic turning seat 71 and the first and second cranks 56*a*, 56*b* are axial. The magnetic turning seat 71 is provided with the first magnetic members 72. Because the second transmission wheel 21*b*, the third and fourth pivotal seats 53*a*', 53*b*', and the first and second transmission rods 4*a*, 4*b* link the first and second guiding rods 54*a*', 54*b*', the first magnetic members 72 bring the first and second eccentric shafts 55*a*, 55*b* to drive the magnetic turning seat 71 to turn synchronously. The position that the first magnetic members 72 pass threrethrough is just located at the overlapping position of the zero moment of the first and second eccentric shafts 55*a*, 55*b* where the second magnetic members 73 are fixed at the lower end of the central frame portion 1*c*. The first and second magnetic members 72, 73 have the same polarity to provide a repulsive force. By means of the repulsive force of the first and second magnetic members 72, 73 of the magnetic turning seat 71, the first and second eccentric shafts 55*a*, 55*b* are pushed away from the overlapping position of the zero moment so as to get out of jamming and provide a smooth turning.

As shown in FIG. 1 through FIG. 12, the first and second pedal rods 6*a*, 6*b* comprise first and second pedals 61*a*, 61*b* fixed at rear ends thereof. The bottom ends of the first and second transmission rods 4*a*, 4*b* are pivotally connected to the middle sections of the first and second pedal rods 6*a*, 6*b*. The bottom ends of the first and second swing rods 3*a*, 3*b* are pivotally connected to the front sections of the first and second pedal rods 6*a*, 6*b*. Through the first and second swing rods 3*a*, 3*b* to swing by turns, the first and second pedal rods 6*a*, 6*b* slide back and forth. The first and second pedal rods 6*a*, 6*b* are pedaled up and down to guide the first and second transmission rods 4*a*, 4*b* to link the first and second pivotal seats 52*a*, 52*b* respectively, such that the first and second pivotal shafts 51*a*, 51*b* are reciprocated clockwise and counterclockwise to bring the first and second guiding members 53*a*, 53*b* (as shown in FIG. 1 to FIG. 8) or the third and fourth pivotal seats 53*a*', 53*b*' (as shown in FIG. 9 to FIG. 12) to turn synchronously, enabling the first and second ropes 54*a*, 54*b* (as shown in FIG. 1 to FIG. 8) secured on the first and second guiding members 53*a*, 53*b* or the first and second guiding rods 54*a*', 54*b*' (as shown in FIG. 9 to FIG. 12) on the third and fourth pivotal seats 53*a*', 53*b*' to reciprocate the first and second eccentric shafts 55*a*, 55*b* with the first and second cranks 56*a*, 56*b* as the axles for pulling by turns so as to turn left or right. This won't influence the first and second pedal rods 6*a*, 6*b* to move forward or rearward.

Furthermore, as shown in FIG. 1 to FIG. 12, when in use, the user grasps the first and second swing levers 3*a*, 3*b* to swing back and forth and pedals the first and second pedals 61*a*, 61*b* of the first and second pedal rods 6*a*, 6*b* up and down. The aforesaid independent swing and the tread motion can be carried out simultaneously by means of the first and second swing levers 3*a*, 3*b* to swing and the first and second pedal rods 6*a*, 6*b* pivotally connected with the bottom ends of the first and second swing levers 3*a*, 3*b* to move up and down, such that the user can pedal on the first and second pedals 61*a*, 61*b* of the first and second pedal rods 6*a*, 6*b* respectively to do tread exercise of elliptical trajectory up and down as well as back and forth.

Accordingly, the first magnetic control wheel 22*a* is able to control the swing resistance of the first and second swing levers 3*a*, 3*b* independently, enabling the first magnetic control wheel 22*a* to control the resistance of the back and forth slide movement of the first and second pedal rods 6*a*, 6*b* only. The second magnetic control wheel 22*b* is able to control the resistance of the up and down tread movement of the first and second pedal rods 6*a*, 6*b* independently. The first and second swing levers 3*a*, 3*b* and the first and second pedal rods 6*a*, 6*b* are swung and pedaled by turns to constitute a tread motion of an elliptical trajectory, such that the mixed resistances of both hands and both feet can control the resistance respectively. The structure is simple, the size is small, the cost is lower, and is a great benefit to use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An elliptical exerciser, comprising:

a frame comprising a first frame portion, a second frame portion, and a central frame portion, first and second magnetic control wheel units arranged in the central frame portion in a top-down configuration and comprising first and second transmission wheels, first and second magnetic control wheels, and first and second belt pulleys, respectively, first, second, and third transmission belts, first and second swing levers pivotally connected to the frame and located on opposite sides of the first and second magnetic control wheel units, first and second transmission rods, first and second guiding mechanisms comprising first and second pivotal shafts, first and second guiding members, first and second ropes, first and second eccentric shafts, and first and second cranks, respectively, and a guiding portion and a main shaft, first and second pedal rods with front ends thereof pivotally connected with bottom ends of the first and second swing levers respectively and with central sections thereof pivotally connected with bottom ends of the first and second transmission rods respectively, and a magnetic mechanism, wherein when the first and second swing levers and the first and second transmission rods are swung forward and rearward synchronously and the first and second pedal rods are pedaled up and down and slide forward and rearward, a tread motion of an elliptical trajectory occurs, the first belt pulley is disposed on a pivot of the first magnetic control wheel and the first transmission belt is engaged around the first belt pulley and the first transmission wheel causing the first magnetic control wheel to rotate; the first magnetic control wheel and the first belt pulley are coaxially disposed at a middle section of the central frame portion and located under the first transmission wheel; the second magnetic control wheel unit is disposed under the first magnetic control wheel unit, the second transmission wheel is pivoted to a lower section of the first frame portion, the second magnetic control wheel is disposed under the second transmission wheel and at the lower section of the first frame portion, the second belt pulley is disposed under the second magnetic control wheel, through the second transmission belt and the third transmission belt, the second belt pulley linking the second transmission wheel and the second magnetic control wheel to rotate respectively;

central sections of the first and second swing levers are connected to first and second swing shafts located at front ends of the first and second frame portions respectively; first ends of the first and second connecting rods are pivotally connected to first and second fixing seats of the first and second swing shafts respectively, second ends of the first and second connecting rods are pivotally connected to two sides of a pivot of the first transmission wheel respectively, enabling the first and second swing levers to swing, such that the first and second connecting rods drive the first transmission wheel to rotate;

upper ends of the first and second transmission rods are pivotally connected to first and second pivotal seats, the first and second pivotal seats are fixed to the first and second pivotal shafts respectively, and the first and second pivotal shafts are fixed to the first and second guiding mechanisms respectively;

front and rear ends of the first and second pivotal shafts are connected with the first and second pivotal seats of the first and second transmission rods and portions of the first and second guiding mechanism respectively, where the first and second guiding mechanisms are connected with the first and second eccentric shafts respectively, and wherein the first and second eccentric shafts are provided with the first and second cranks and the main shaft, and wherein the first and second cranks and the main shaft are coaxial, and the main shaft penetrating the second transmission wheel;

the magnetic mechanism comprising a magnetic turning seat, first magnetic member, and second magnetic member, the magnetic turning seat is fixed to one side of the main shaft, the magnetic turning seat and the first and second cranks are coaxial, the magnetic turning seat is provided with the first magnetic member, where the second transmission wheel, the first and second guiding members, and the first and second transmission rods link the first and second ropes synchronously, the first magnetic member bringing the first and second eccentric shafts to drive the magnetic turning seat to turn synchronously, a position that the first magnetic member pass therethrough is at an overlapping position of a zero moment of the first and second eccentric shafts where the second magnetic member is fixed at a lower section of the central frame portion, the first and second magnetic members having the same polarity to provide a repulsive force, by means of the repulsive force of the first and second magnetic members of the magnetic turning seat, the first and second eccentric shafts are pushed away from the overlapping position of the zero moment so as to provide a smooth turning.

2. The elliptical exerciser as claimed in claim 1, wherein the guiding portion of the first and second guiding mechanisms comprises first and second guiding members and the first and second ropes, the first and second guiding members are secured on the first and second pivotal shafts respectively, the first and second ropes are fixed to front ends of the first and second guiding members respectively, and the first and second ropes pass around the first and second guiding members to be located at rear ends of the first and second guiding members and connected with the first and second eccentric shafts, respectively.

* * * * *